US007025136B2

(12) United States Patent
Tulloch et al.

(10) Patent No.: US 7,025,136 B2
(45) Date of Patent: Apr. 11, 2006

(54) TORQUE REDUCTION TOOL

(75) Inventors: Rory McCrae Tulloch, Aberdeen (GB); James Bain, Montrose (GB); Binnert Ruerd Haites, Aberdeen (GB); Mike Wardley, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 168 days.

(21) Appl. No.: 10/181,229

(22) PCT Filed: Jan. 5, 2001

(86) PCT No.: PCT/GB01/00039

§ 371 (c)(1),
(2), (4) Date: Nov. 25, 2002

(87) PCT Pub. No.: WO01/51759

PCT Pub. Date: Jul. 19, 2001

(65) Prior Publication Data

US 2003/0132005 A1 Jul. 17, 2003

(30) Foreign Application Priority Data

Jan. 15, 2000 (GB) ..... 0000817

(51) Int. Cl.
*E21B 17/10* (2006.01)

(52) U.S. Cl. ..... 166/241.7; 175/325.6

(58) Field of Classification Search ..... 166/380, 166/241.6, 241.7; 175/325.1, 325.5, 325.6
See application file for complete search history.

(56) References Cited

U.S. PATENT DOCUMENTS

| | | | | |
|---|---|---|---|---|
| 1,926,582 | A * | 9/1933 | Craig et al. | 175/325.6 |
| 1,974,546 | A * | 9/1934 | Shipley | 175/325.6 |
| 2,252,978 | A * | 8/1941 | Parkin | 175/325.6 |
| 5,069,297 | A * | 12/1991 | Krueger et al. | 175/65 |
| 5,579,854 | A * | 12/1996 | Barry | 175/57 |
| 5,692,563 | A * | 12/1997 | Krueger et al. | 166/85.5 |
| 6,032,748 | A * | 3/2000 | DeBray et al. | 175/325.7 |
| 6,250,406 | B1 | 6/2001 | Luke | 175/325.2 |
| 2002/0038727 | A1 * | 4/2002 | Moore et al. | 175/325.5 |

OTHER PUBLICATIONS

International Search Report dated Aug. 13, 2001, for application serial No. PCT/GB01/00039.

* cited by examiner

*Primary Examiner*—William Neuder
(74) *Attorney, Agent, or Firm*—Patterson & Sheridan LLP

(57) ABSTRACT

A tool for reducing torque on work string, eg for gas or oil production, comprises an upper clamp (2), a lower clamp (3) and connection means (4), the three components formed as a unitary structure (1). The tool also comprises bearing means, preferably made from an elastomeric compound, and an annular body (7) (see FIG. 4) held in place over the connection means by the clamps. The clamps may comprise spigots (5) for retaining the connection means. In a preferred embodiment the annular body is in two semi-annular components connected at one end to allow them to pivot, and the other end comprises mating castellations for receiving a fastening pin. The annular body may comprise a number of replaceable wear pads (14) which may be made of bronze or an elastomer. The unitary structure of the tool enhances the integral strength and efficiency of the clamps.

8 Claims, 3 Drawing Sheets

TORQUE REDUCTION TOOL

The present invention relates to a torque reduction tool, as is typically used with a work string in gas and oil production.

Well bores are conventionally created using a drill bit attached to a string of drill pipe, commonly known as a "work string" or "drill string", which is advanced into the new bore from the surface. The newly drilled section of the well bore is then lined with structural casing which is cemented in place when set.

As a work string is passed through a bore, which has already been lined, it frequently contacts the casing, and as a result, the rotational movement of the work string gradually wears the casing wall. Such wear is enhanced by abrasive mud particles typically found within a downhole environment. Furthermore, frequent contact between the casing and tool string causes torque and drag which hinder rotation of the work string and impedes progress of the string along the bore.

Torque and wear are especially problematic during drilling processes which require the work string to be progressed along a curved path. In horizontal or extended wells, both friction and torque are increased as a result of the increased contact between the work string and casing.

It is known in the art that fitting a protector to the tool string may reduce both rotary torque and casing wear. Conventionally, such protectors are comprised of an annular body which fits around the work string. U.S. Pat. No. 50,069,297 teaches of a work string protector which is comprised of a protective sleeve mounted on a length of drill pipe which prevents damaging contact between the tool string and casing wall. The protector is secured to the tool string via independent clamps or "thrust bearings" which are removably attached to the tool string above and below the protective sleeve thereby leaving a separate narrow working clearance at either end.

While this protector mitigates casing wear and reduces torque, the efficiency of the clamps which are independent of the torque reduction tool and which hold the protector in place are tested in the downhole environment where hostile chemical conditions, high loading, and temperature are prevalent. In particular, in the event that the very high loading and rotational movement of the work string tears the clamps from the work string the clamps are left free to obstruct the passage of any further apparatus in the bore. Furthermore, if a clamp is broken off in such a manner, or if it slips independently along the work string, the protector can move longitudinally along the work string, in the direction which was previously restricted. In this circumstance the protector can easily become detached from the work string. Therefore as each of the components in conventional torque reduction tools are individual entities, protecting ability is lost even if only one of the clamps fails and the other remains intact. It would therefore be advantageous to provide a torque reduction tool wherein the strength of the clamps is enhanced by the structural integrity of the torque reduction tool and clamps, so that in the event of one of the clamps failing the remaining clamp would still be able to retain the torque reduction tool in place on the work string.

It is an object of the present invention to provide a torque reduction tool which reduces casing wear and torque produced by the rotation of a work string in a well bore.

It is a further object of the present invention to provide a torque reduction tool with superior clamping qualities which fixes the position of the protector in a stationary position on the work string.

It is a further object of the present invention to provide a torque reduction tool wherein the clamps which hold the torque reduction tool in place form a unitary mechanical structure with the other components of the tool.

According to a first aspect of the present invention there is provided a torque reduction tool comprising upper and lower clamps and a connection means, wherein the upper and lower clamps and connection means combine to form a unitary mechanical structure, and wherein the torque reduction tool further comprises bearing means for providing a low friction contact between the tool and pipe or casing, the bearing means being provided on an annular body which is held in place, over the connection means, by the upper and lower clamps.

Preferably the upper and lower clamps are constructed from bronze although any other material suitable for bearing tensile or compression loads could be used.

Preferably the connection means is constructed from steel although any other material suitable for bearing tensile or compression loads could be used.

Preferably each clamp is comprised of two or more part annular components which are connected by hinges.

Alternatively each part annular component has a formation at one respective end, wherein the formations of the part annular components can co-operate with each other to allow them to pivot.

Preferably each clamp has retaining means, spigot or the like, for receiving said connection means.

Preferably the annular body has replaceable wear pads on the external surface of the body.

Preferably the replaceable wear pads of the annular body are made from a relatively resistant and hard wearing material such as bronze, although any other suitable material could be used.

Alternatively the wear pads are made from a soft, sacrificial material such as an elastomer.

Preferably the sacrificial wear pads are replaceable.

Preferably the bearing means is made from an elastomeric material.

Preferably the bearing means is fixed to the annular body in such a manner that the bearing means does not move relative to the annular body.

Preferably the bearing means is fixed to the annular body by screws which fit into corresponding elements in the bearing means and annular body.

Typically the annular body is made of a soft metallic material such as aluminium although any other suitable material could be used.

Preferably the annular body is comprised of two semi annular components.

Preferably the semi annular components are connected at one circumferential end by hinges.

Preferably the semi annular components have a second circumferential end with mating means.

Preferably the clamp has receiving means for accepting a pin or the like.

Also according to the present invention there is provided a torque reduction tool, comprising an upper and lower clamp and annular body, wherein at least one of the upper and lower clamps has receiving means for receiving a pin or the like, wherein the pin can pass through the receiving means of the clamp into corresponding receiving means in the annular body and wherein the clamps are adapted to block subsequent passage of the pin.

According to a second aspect of the present invention there is provided a method for securing a torque reduction tool around a work string, the torque reduction tool comprising an upper and lower clamp and connection means and an annular body which is positioned on the work string between said clamps, using a pin which fits into receiving means in the upper clamp and corresponding receiving means in castellations on the annular body, comprising the steps of:

A) positioning the integral clamp and connection means on the work string via bolting or the like;

B) positioning the annular body around the workstring in between said clamps;

C) passing a pin or the like through the receiving means of the upper clamp and into the receiving means of the annular body castellations thereafter.

An example embodiment of the invention will now be illustrated with reference to the following Figures in which.

Figure 1:
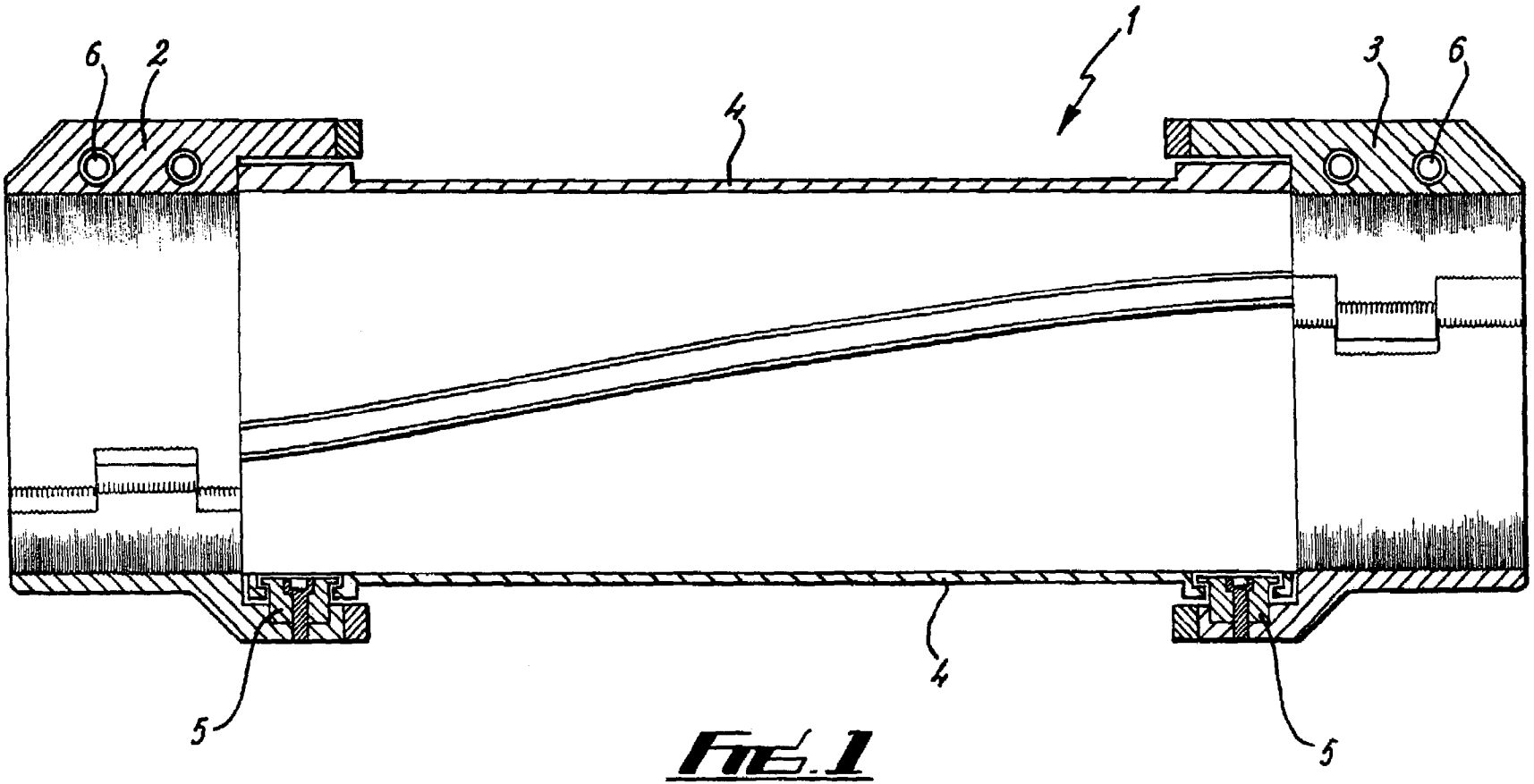
FIG. 1 is a half section diagram showing the assembly of a torque reduction tool on a work string in accordance with the present invention.

Referring firstly to FIG. 1 a torque reduction tool, generally depicted at 1, is comprised of an upper 2 and lower clamp 3, and connection means 4. Both the upper 2 and lower 3 clamps have spigots 5, into which the connection means 4 fits, wherein on connection of the connection means 4 to the upper 2 and lower 3 clamps a unitary mechanical structure is formed.

To assemble the torque reduction tool, the connection means 4 is used to join clamps 2 and 3. The clamps 2 and 3 are essentially identical but are referred to from here on as an upper and lower clamp to describe the ultimate position of each on the work string. The connection means 4 fit into spigot structures 5 on the clamps which act to retain the connection means 4 in place, and in this manner a unitary mechanical structure is constructed. However the advantage of the structure shown is that, whilst it is a single structural unit, it incorporates three separate components which can be replaced individually if required. The structure is fastened onto the section of work string (not shown) where protection and torque reduction is required and secured using appropriate fixing means such as bolts or screws 6.

Figure 2:
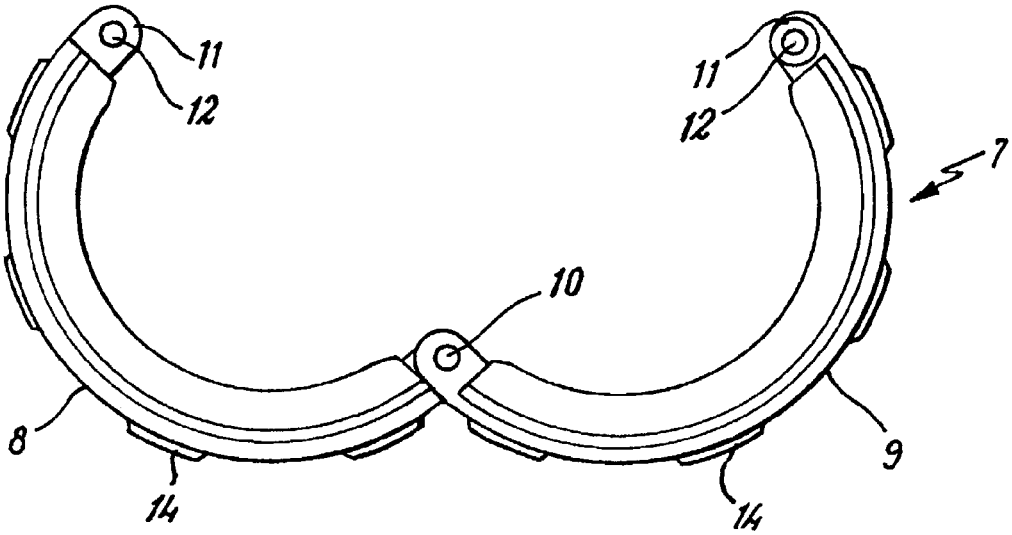
FIG. 2 is an elevated view of an annular body component in isolation.
Figure 3:
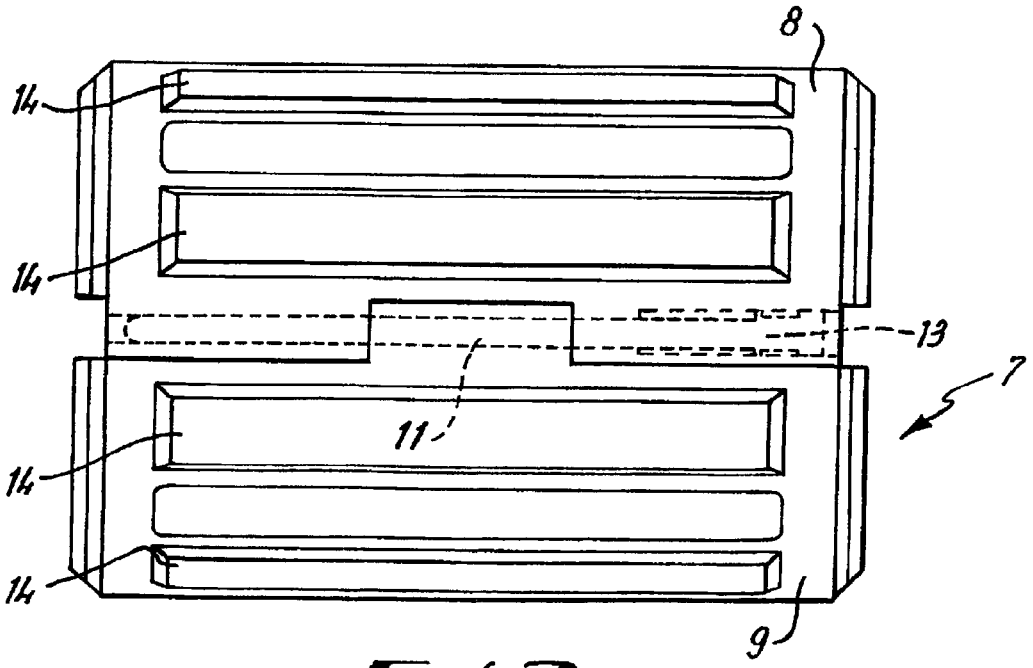
FIG. 3 is a side view of an annular body component in isolation.

FIGS. 2 and 3 show alternative views of the annular body, which is generally depicted at 7. The annular body 7 is comprised of two semi annular components 8 and 9 which are hinged together at 10 to allow the annular body to be opened in order to fit over the work string (not shown). The annular body 7 further comprises castellations 11 which come into alignment when the annular body 7 is closed around the work string. The castellations 11 have receiving means 12 which run centrally through the length of the castellations 11 and are shaped to receive a fastener, typically a pin 13, which holds the two semi annular components 8 and 9 closed around the work string. The annular body 7 also has wear pads 14 on the external surface, which are constructed from a hard wearing material such as bronze and can be replaced if required. In the present embodiment the replaceable wear pads 14 are arranged on the annular body 7 as strips which run the entire longitudinal length of the body, although any other suitable design could be used. The wear pads 14 are the first point of contact between the casing and the annular body 7 and therefore act sacrificially to increase the lifespan of the annular body 7 itself.

Figure 4:
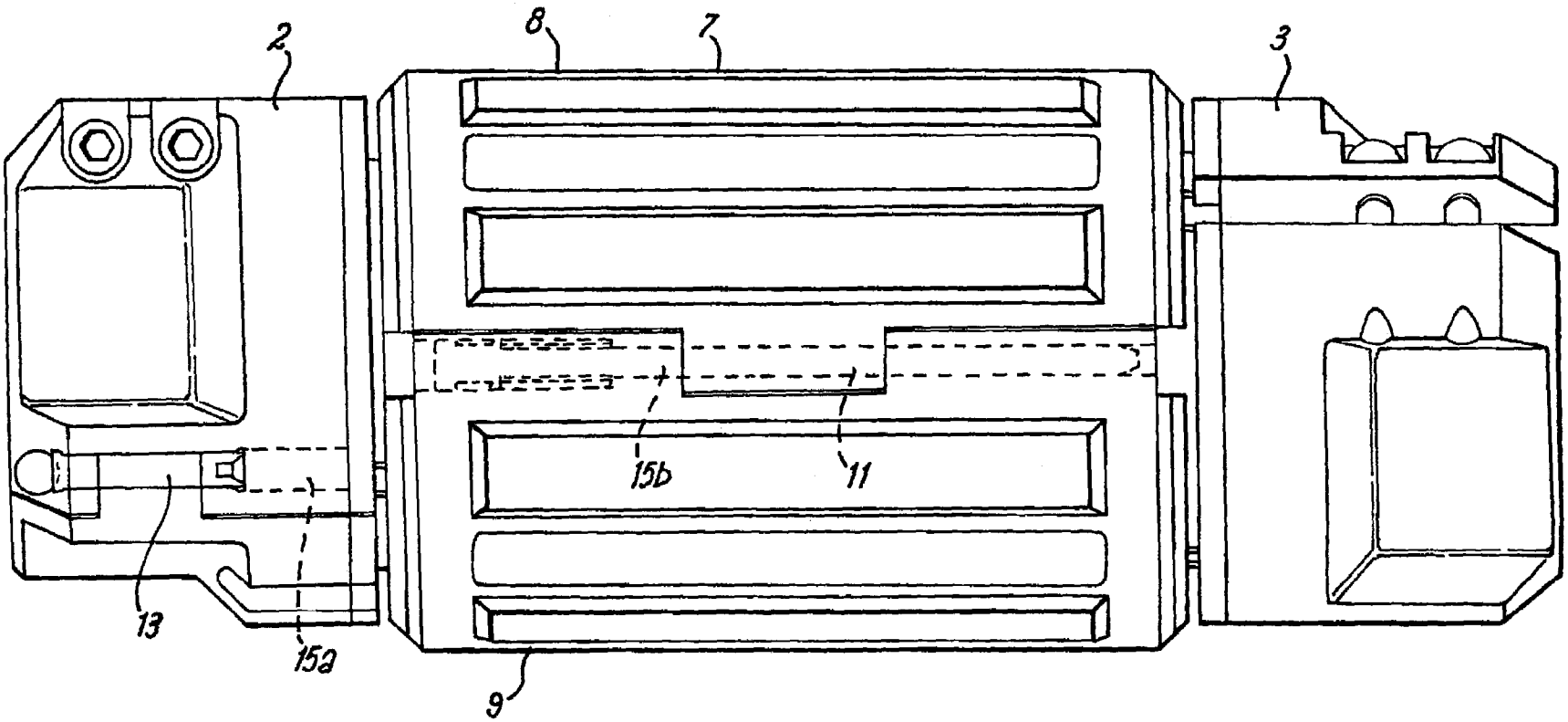
FIG. 4 is a torque reduction tool as assembled on a work string.

FIG. 4 shows the torque reduction tool as it appears when assembled on a work string (not shown). The upper 2 and lower 3 clamps are held together by the connection means (not shown). The protective annular body 7 sits over the connection means on the work string and between the upper 2 and lower 3 clamps. The torque reduction tool further comprises bearing means (not shown) which are constructed from an elastomeric material and are attached to the internal surface of the annular body 7. The work string encased by the torque reduction tool is free to rotate relative to the annular body 7 and bearing means and is therefore not obstructed from performing its normal function.

The annular body 7 can be fitted over the work string as it is comprised of two semi annular components 8 and 9 which are hinged together. The semi annular components are closed around the work string, aligning the mating castellations 11 of the semi annular components 8 and 9. The mating castellations 11 and upper clamp 2 have receiving means 15*a* and 15*b* for receiving a fastening pin, 13. To secure the annular body 7 shut, the receiving means 15*a* of the upper clamp 2 and receiving means 15*b* of the annular body castellations 11 are aligned. The fastening pin 13 can then be passed through the receiving means 15*a* of the upper clamp, into the receiving means 15*b* of the annular body castellations.

The advantage of the present invention is that the clamps and torque reduction tool are integrated into a unitary mechanical structure. The integral strength and efficiency of each of the clamps is therefore enhanced as each clamp is supported by the rest of the tool and can therefore effectively restrain the torque reduction tool in place, at loading levels and under circumstances where a non-unitary design would have failed. This ensures that the torque reduction tool is retained on the section of the work string that it is required.

Further modifications and improvements may be incorporated without departing from the scope of the invention herein intended.

The invention claimed is:

1. A torque reduction tool, comprising an upper and lower clamp and a connection member, wherein the upper and lower clamps and connection member combine to form a unitary mechanical structure, and wherein the torque reduction tool further comprises one or more bearing members for providing a low friction contact between the tool and pipe or casing, the bearing members being provided on an annular body adapted to fit about an outer diameter of the connection member, and held in place by the upper and lower clamps, wherein at least one of the upper and lower clamps has a receiving portion for receiving a pin or the like, wherein the pin can pass through the receiving portion of the clamp into a corresponding receiving portion in the annular body and wherein the damps are adapted to prevent the pin from exiting from either receiving portion.

2. A method for securing a torque reduction tool around a work string, the torque reduction tool comprising an upper and lower clamp and a connection member and an annular body which is positioned on the work string between the damps, using a pin which fits into a receiving portion in the upper clamp and corresponding receiving portion in castellations on the annular body, comprising:

A) positioning the integral clamp and connection member on the work string;

B) positioning the annular body around the work string in between the clamps; and C) passing a pin or the like through the receiving portion of the upper clamp and into the receiving portion of the annular body castellations.

3. The method of claim 2, wherein the work string is rotatable relative to the annular body.

4. The method of claim 2, further comprising positioning one or more bearings mechanisms between the annular body and the connection means to allow rotation of the annular body relative to the work string.

5. A torque reduction tool comprising upper and lower damps and a connection member, wherein the upper and lower damps and connection member combine to form a unitary mechanical structure, and wherein the torque reduction toot further comprises one or more bearing members for providing a low friction contact between the tool and pipe or casing, the bearing members being provided on an annular body which is held in place, over the connection member, by the upper and lower clamps, wherein the upper and lower clamps are constructed from bronze.

6. A torque reduction tool comprising upper and lower clamps and a connection member, wherein the upper and lower damps and connection member combine to form a unitary mechanical structure, and wherein the torque reduction tool further comprises one or more bearing members for providing a low friction contact between the tool and pipe or casing, the bearing members being provided on an annular body which is held in place, over the connection member, by the upper and lower clamps, wherein each clamp has a retaining portion for receiving the connection member.

7. The torque reduction tool of claim 6, wherein the retaining portion is a spigot.

8. A torque reduction tool comprising upper and lower damps and a connection member, wherein the upper and lower damps and connection member combine to form a unitary mechanical structure, and wherein the torque reduction tool further comprises one or more bearing members for providing a low friction contact between the tool and pipe or casing, the bearing members being provided on an annular body which is held in place, over the connection member, by the upper and lower clamps, wherein the bearing member is fixed to the annular body by screws which fit into corresponding elements in the bearing member and annular body.

* * * * *

UNITED STATES PATENT AND TRADEMARK OFFICE

CERTIFICATE OF CORRECTION

PATENT NO. : 7,025,136 B2
APPLICATION NO. : 10/181229
DATED : April 11, 2006
INVENTOR(S) : Rory McCrae Tulloch et al.

It is certified that error appears in the above-identified patent and that said Letters Patent is hereby corrected as shown below:

In the Claims section:

column 5, Claim 5, line 8, please delete [damps] and insert --clamps--.

column 5, Claim 5, line 9, please delete [damps] and insert --clamps--.

column 5, Claim 6, line 19, please delete [damps] and insert --clamps--.

column 6, Claim 8, line 10, please delete [damps] and insert --clamps--.

column 6, Claim 8, line 11, please delete [damps] and insert --clamps--.

Signed and Sealed this

Twenty-first Day of November, 2006

JON W. DUDAS
*Director of the United States Patent and Trademark Office*